US006247756B1

(12) United States Patent
Wagner

(10) Patent No.: US 6,247,756 B1
(45) Date of Patent: Jun. 19, 2001

(54) SAFETY AND TORSO POSITIONING APPARATUS

(76) Inventor: Emil Wagner, 1354 33rd Pl., Forest Grove, OR (US) 97116

( * ) Notice: Subject to any disclaimer, the term of this patent is extended or adjusted under 35 U.S.C. 154(b) by 0 days.

(21) Appl. No.: 09/632,252

(22) Filed: Aug. 3, 2000

(51) Int. Cl.[7] ..... A61G 5/00; A62B 35/00
(52) U.S. Cl. ..... 297/484; 297/485
(58) Field of Search ..... 297/484, 485, 297/483

(56) References Cited

U.S. PATENT DOCUMENTS 1,368,466 * 2/1921 Tyler ..... 297/484
2,851,033 * 9/1958 Posey ..... 297/485 X
3,565,483 * 2/1971 Posey ..... 297/484
4,177,807 12/1979 Ocel et al. .
4,231,616 * 11/1980 Painter ..... 297/484
4,455,046 6/1984 Linderoth .
5,056,869 * 10/1991 Morrison ..... 297/484 X
5,297,852 3/1994 Morales-Quintero .
5,380,067 * 1/1995 Turvill ..... 297/484
5,626,398 5/1997 Wooldridge .
5,727,843 3/1998 LaTrace .
5,816,662 * 10/1998 Rumburg ..... 297/485 X

* cited by examiner

*Primary Examiner*—Peter R. Brown
(74) *Attorney, Agent, or Firm*—Rose Jade; William S. Lovell

(57) ABSTRACT

The safety and torso positioning apparatus consists of three straps removably anchored to a wheelchair or the like and adjustably fastened to hold the seated occupant and stabilize the occupant's torso in a vertical position.

17 Claims, 4 Drawing Sheets

SAFETY AND TORSO POSITIONING APPARATUS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

This invention relates to apparatus for securing a sitting person in an upright position by adjustable and easily removable means.

2. Background Information

Means for securing persons safely within a chair have long been studied and developed, with particular attention paid to the safety, dignity, and liberty needs of medical and nursing home patients. Under normal circumstances, the chaired person desires, and must be able, to free him or herself from the safety device and chair. Further, in medical and nursing home environments, federal law prohibits the use of restraints, except under special circumstances. See, e.g., 42 USC 1395i-3(c)(1)(A)(ii)("a skilled nursing facility must protect and promote the rights of each resident, including . . . the [right to be] . . . [f]ree from . . . any physical . . . restraints . . . ").

The following disclosure will point out those patents related thereto of which Applicant is aware. Most devices act to belt in the chaired person at the waist and fail to provide means for stabilizing the person's torso in the upright, vertical plane. This is a matter of singular importance to any person suffering from weakness, paralysis, muscular dystrophy, or the like, whose torso is caused to slump sideways while seated in the chair and secured only by a traditional wheelchair lap belt. Further, most devices require permanent attachment to the chair and are not easily removable for cleaning, strap replacement, or temporary use on another chair. The present invention provides a positioning and securing means for permitting the use of a chair, particularly a wheelchair, in a more dignified, fully upright manner. Additionally, the invention can be easily attached to, and removed from the wheelchair, without tying. The apparatus can be made from machine-washable material. The three straps are individually removable and replaceable. The invention can accept a variety of strap fastening and length-adjusting means, to allow for use under a variety of circumstances. For persons with use of their arms and hands, the apparatus can be used without any assistance by others.

U.S. Pat. No. 4,177,807 issued Dec. 11, 1979 to Ocel et al. describes a device that permanently secures to the back of a wheel chair, hospital bed or the like, reaches around to encompass a person sitting in the wheel chair, hospital bed or the like, and then attaches the distal end thereof to the proximal end of the device by means of Velcro fasteners. Means for positioning a person's torso in the vertical plane are not provided. The device has a structure specifically designed to prevent a person strapped therein, from making egress therefrom.

U.S. Pat. No. 4,455,046 issued Jun. 19, 1984 to Linderoth describes a safety device permanently affixed to a wheelchair, that combines a seat belt used to secure a person within the wheel chair, with a securing mechanism interconnected between the wheel chair and a hold-down component on a transport vehicle such as a train coach, ship or aircraft. Means for positioning a person's torso in the vertical plane are not provided.

U.S. Pat. No. 5,297,852 issued Mar. 29, 1994 to Morales-Quintero describes a one-piece removable security harness for a wheel chair or a bed comprising a crotch panel combined with a waist strap and contiguous front and rear panels into which a person is placed, together with respective pairs of straps that extend from the front and rear panels and must be tied to the pushing handles of a wheel chair or the sides of a bed. This device must be put on the person first, before the device is secured to the support chair or bed. The device does not enable the person so held to access conveniently the means for disconnecting or removing the device, and hence acts as a restraint. The one-piece ensemble does not allow for immediate single strap replacement or washing.

U.S. Pat. No. 5,626,398 issued May 6, 1997 to Wooldridge describes a safety strap that is permanently affixed to a chair and may be wrapped around a person sitting in a wheel chair and secured at the back thereof. No means for positioning a person's torso in the vertical plane are provided, and the inaccessibility of the securement means, to the person in the chair, causes this device to act as a restraint.

U.S. Pat. No. 5,727,843 issued Mar. 17, 1998 to LaTrace describes a seat belt permanently affixed and extending upwards from below the seating area of a four-wheeled comfort chair, the seat belt having a release mechanism the same as those currently common in motor vehicles. Means for positioning a person's torso in the vertical plane are not provided.

Based upon the foregoing, there has been a need for a removable safety device for securing a person in a chair in a manner that stabilizes and positions the person's torso in the vertical plane, and allows for easy egress therefrom. Such a device is shown and described in the present application.

BRIEF SUMMARY OF THE INVENTION

The apparatus consists of a spanning strap placed over the chair back, and two elongated, length-adjustable, vertical positioning straps extending therefrom, which attach to the seat frame of the chair, and to each other at the waist area of the seated person. When a person is seated in the chair, each positioning strap drapes over a shoulder, front torso and thigh area. The bottom portion of each vertical positioning strap is looped around the chair's seat area, adjusted to a comfortable length, and secured to itself above the person's thigh, by a fastening means. A fastening means draws and secures the vertical positioning straps together at approximately waist-level. The apparatus can be left on the chair, or easily removed for cleaning, or transfer to another chair. Each positioning strap can accept a variety of fastening means, and can be individually removed for replacement or cleaning.

DETAILED DESCRIPTION OF THE INVENTION

Figure 1:
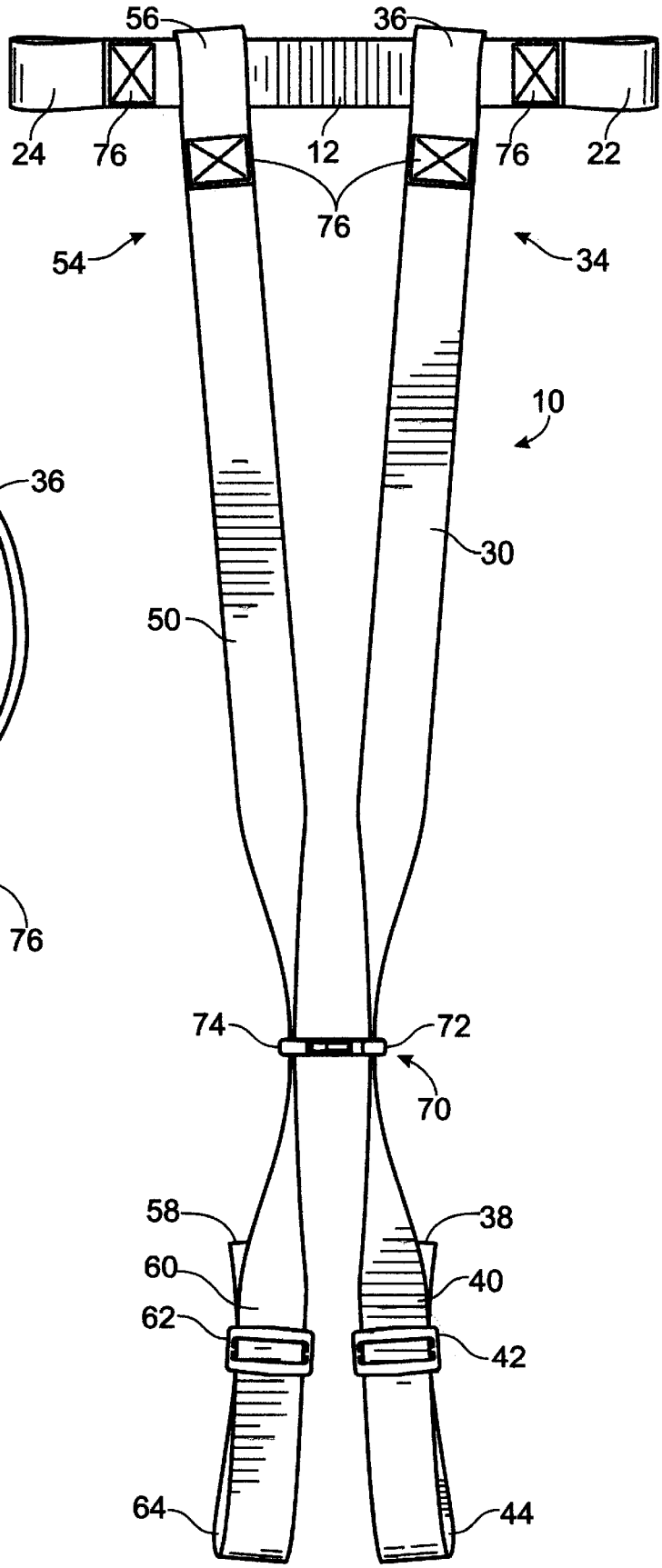
FIG. 1 is a plan view of a preferred embodiment of the present invention.

Referring now to the drawings in greater detail, FIG. 1 shows the preferred embodiment of safety and positioning apparatus 10 comprising the present invention. It consists of a spanning strap 12 with removable attachment means 22 and 24 for attaching to the upper back area of a chair, and two vertical positioning straps 30 and 50, each removably attached to spanning strap 12 by slideably attachment means 36 and 56. Vertical positioning strap 30 has removable adjustable chair attachment means 42 and 44 disposed at the distal end thereof. Vertical positioning strap 50 has removable adjustable chair attachment means 62 and 64 disposed at the distal end thereof. Vertical positioning strap 30 fastens to vertical positioning strap 50 by removable fastening means 70.

Figure 2:
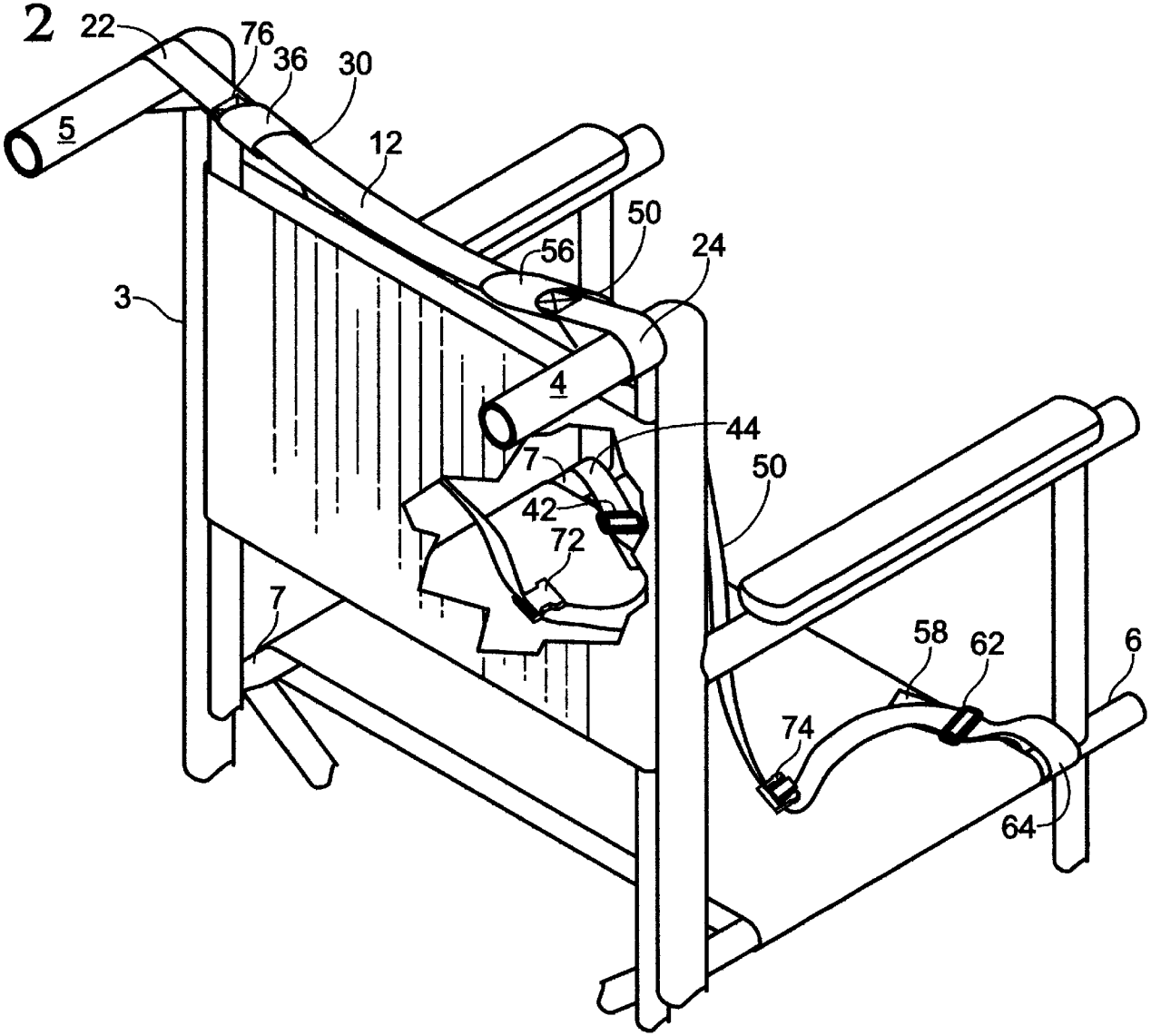
FIG. 2 is a rear oblique view of the present invention secured to a wheelchair.

FIG. 2 shows the straps 12, 30 and 50 attached to wheelchair 3 having pushing bars 4 and 5 in the upper back area of wheelchair 3, and horizontal seat bars 6 and 7. It should be noted that although the invention is described as for use with a wheelchair, the invention could be used with any type of chair that has an upper portion and seat area to which the straps may be attached to.

Figures 5, 6:
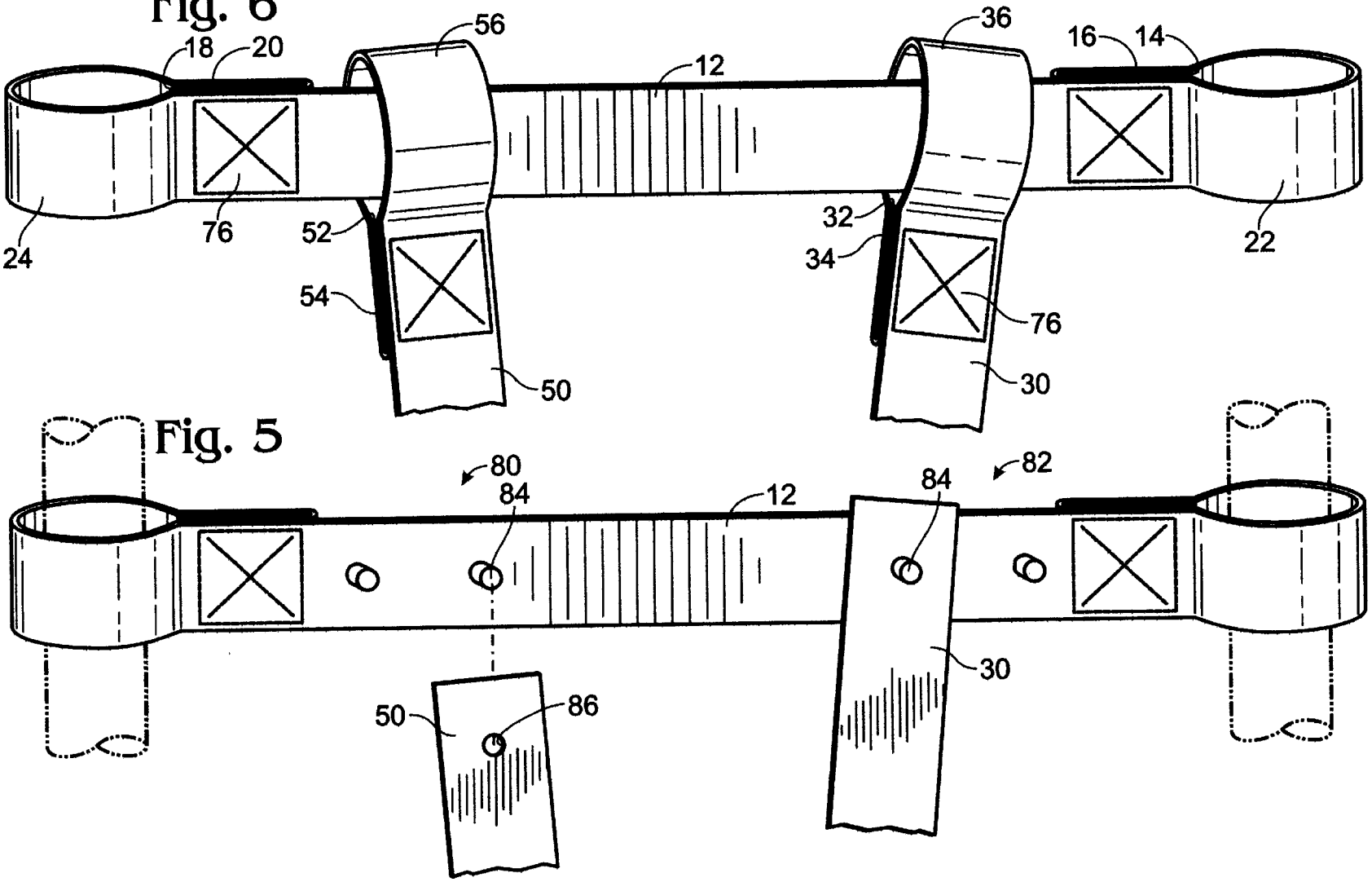
FIG. 5 is a view of strap attachment means employing posts (84) and post apertures (86).
FIG. 6 is a view of strap attachment means employing loops (22, 24, 36, 56).

As shown in FIG. 2, spanning strap 12 is attached to the upper rear pushing bars 5 and 6 of wheelchair 3, by attachment means 22 and 24. This attachment means can be accomplished by any conventional means, such as, but not limited to, anchoring spanning strap left end 14 to left portion 16 to form a closed loop 22, and anchoring right end 18 to right portion 20 to form a closed loop 24, as shown in FIG. 6. This strap anchoring can be accomplished by any conventional means, such as, but not limited to, sewing through spanning strap 12, as shown in FIG. 1 at 76. The looped means 22 and 24 for attaching spanning strap 12 to wheelchair 3, as shown in the preferred embodiment, allows spanning strap 12 to be so placed without a tying action, which is an advantage for persons suffering from arthritis or who have other limits on their manual dexterity. Other types of chair attachment means for the spanning strap 12 could be used without departing from the scope of the invention. Another example would be sewing VELCRO onto the spanning strap left and right portions 16 and 20 to facilitate wrapping each portion 16 and 20 around the upper portion of a chair.

Figure 4:
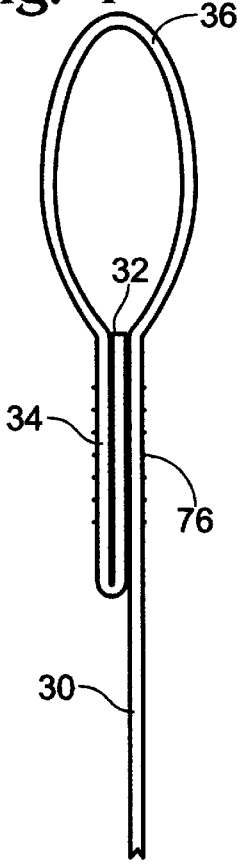
FIG. 4 is a close-up of strap anchoring (76) used to form loop attachment means (22, 24, 36, 56)

As shown in FIG. 1 and FIG. 6, each vertical positioning strap 30 and 50 is removably and adjustably attached to spanning strap 12, by slidable means 36 and 56. This slideable attachment can be accomplished by any conventional means, such as, but not limited to, anchoring vertical positioning strap top end 32 to top portion 34 to form a closed loop 36, and anchoring top end 52 to top portion 54 to form a closed loop 56, where said loops 36 and 56 are wide enough to allow spanning strap 12 to pass therethrough, as shown in FIG. 6. This strap anchoring can be accomplished by any conventional means, such as, but not limited to, sewing 76 as shown in FIG. 4 and FIG. 6.

Other types of removable attachment means for attaching vertical positioning straps 30 and 50 to spanning strap 12 could be used without departing from the scope of the invention. As shown in FIG. 5, a removable attachment means can be accomplished by anchoring at least one post 84 to post placement areas 80 and 82 of spanning strap 12, and providing at least one post aperture 86 on each strap 30 and 50.

Other types of removable and also adjustable attachment means can be accomplished without departing from the scope of the invention. As shown in FIG. 5, a removable and adjustable attachment means can be accomplished by anchoring two or more posts 84 on post placement area 80 and 82 of spanning strap 12, and constructing a post aperture on each strap 30 and 50. Another example of removable and adjustable attachments means for attaching vertical positioning straps 30 and 50 to spanning strap 12 would be provided by anchoring VELCRO to spanning strap 12 and to the top portions 34 and 54 of vertical positioning straps 30 and 50.

Figure 3:
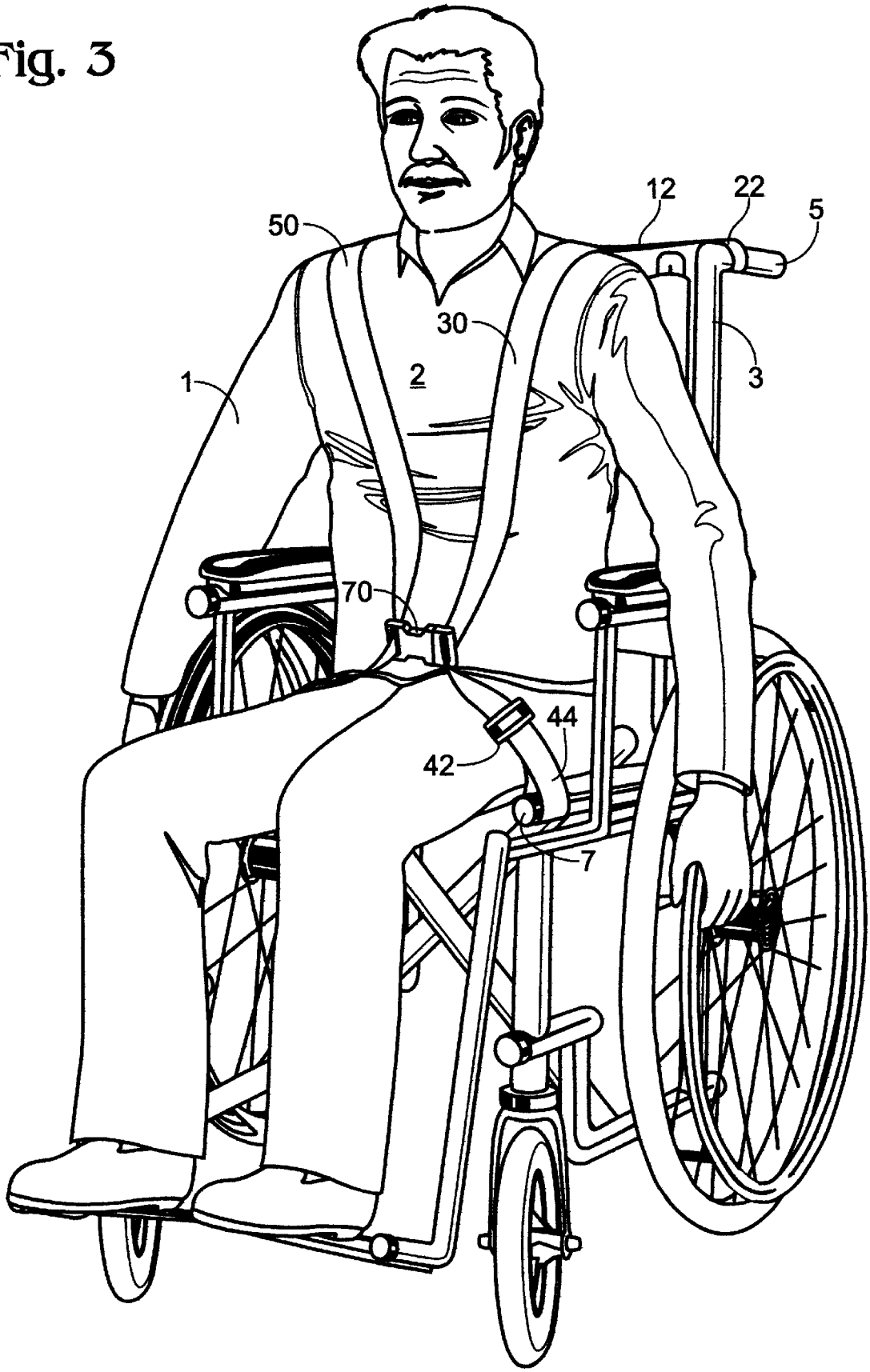
FIG. 3 is a front oblique view of a person seated in a wheelchair using the present invention.

As shown in FIG. 2 and FIG. 3, vertical positioning straps 30 and 50 are attached at their bottom portions 40 and 60 to the horizontal bars 6 and 7 in the seat area of wheel chair 3 by removable adjustable means 42, 44, 62 and 64. This attachment means can be accomplished by any conventional means, such as, but not limited to, threading adjustment buckle 42 onto vertical positioning strap 30, winding bottom portion 40 around horizontal seat bar 7 to form loop 44, inserting bottom end 38 through adjustment buckle 42 and adjusting the length and snugness of vertical positioning strap 30 thereby; and threading adjustment buckle 62 onto vertical positioning strap 50, winding bottom portion 60 around horizontal seat bar 6 to form loop 64, inserting bottom end 58 through adjustment buckle 62 and adjusting the length and snugness of vertical positioning strap 50 thereby. Adjustably removable attachment means 42, 44, 62 and 64 allows the length of each vertical positioning strap to be individually adjusted to each side of chaired person 1. Other ways of providing adjustable, removable attachment of vertical positioning straps 30 and 50 to the seat area of a chair could be used without departing from the scope of the invention. For example, facing the bottom portions 40 and 50 with VELCRO could also be used. Other means for removable attachment of vertical positioning straps 30 and 50 could be used without departing from the scope of invention. For example fixedly attaching at least one post 84 and post aperture 86 to bottom portions 40 and 60 could be employed.

As shown in FIG. 3, vertical positioning straps 30 and 50 fasten together by removable fastening means 70 found proximate to torso 2 of seated person 1. As shown in FIG. 1 and FIG. 2, left vertical positioning strap 30 has removable fastening means left portion 72 adjustably disposed intermediate to top portion 34 and bottom portion 40. Right vertical positioning strap 50 has removable fastening means right portion 74 adjustably disposed intermediate to top portion 54 and bottom portion 60. Each fastening means portion 72 and 74 can be placed to favor right or left handedness of person 1. An example of a removable fastening means includes, but is not limited to, a manually operated buckle 70 used with conventional safety or restraining belts. Other types of fastening means could be used. For example, an electronically operated fastening means could be employed by persons who lack use of their arms or hands.

Different types of fastening means could be used interchangeably or temporarily, without departing from the scope of invention.

In order to use the safety and torso positioning apparatus 10 all that is necessary is to first place the spanning strap 12 on the upper portion of a chair, then drape the vertical positioning straps 30 and 50 over each side of one's torso 2, wrap bottom portions 40 and 50 around each respective seat area, insert bottom ends 38 and 58 into adjustment buckles 42 and 62 adjust the length and snugness of each vertical positioning strap thereby, and secure oneself in by fastening means 70. If one cannot use one's arms or hands sufficiently to position and adjust the straps oneself, a second person may assist. To free oneself from the apparatus, one simply opens the fastening means 70. If the chair is to be used by the same person each time, upon departure from the chair the apparatus may remain attached to the chair, to allow for quick re-seating.

It will be understood by those of ordinary skill in the art that other arrangements and disposition of the aforesaid components, the descriptions of which are intended to be illustrative only and not limiting, may be made without departing from the spirit and scope of the invention, which must be identified and determined from the following claims and equivalents thereof.

I claim:

1. A safety and torso positioning apparatus, comprising:

a spanning strap having a left portion, left end, right portion and right end;

means for removably attaching said spanning strap to an upper portion of a chair;

two vertical positioning straps each having a top portion, top end, bottom portion and bottom end;

means for removably attaching said top portions of said vertical positioning straps to said spanning strap in a mutually facing disposition;

means for removably attaching said bottom portions of said vertical positioning straps to a chair; and means for temporarily fastening said vertical positioning straps one to the other at a point intermediate said top and bottom portions of said vertical positioning straps.

2. Apparatus as in claim 1 wherein said means for removably attaching said spanning strap to a chair comprises a loop formed by anchoring said spanning strap left portion to itself and said spanning strap right portion to itself to form a pair of loops of minimum circumference to fit over the upper portion of a chair.

3. Apparatus as in claim 2 wherein said means for removably attaching said vertical positioning straps to said spanning strap comprises a loop formed by anchoring each said upper portion of said vertical positioning strap to itself to form a loop of such minimum circumference as to allow said spanning strap to slide therethrough.

4. Apparatus as in claim 3 wherein said means for attaching said lower portions of said vertical positioning straps to a chair comprises a removable buckle adapted to receive said bottom end of said vertical positioning strap.

5. Apparatus as in claim 4 wherein said means for temporarily fastening said vertical positioning straps one to the other is removable.

6. Apparatus as in claim 4 wherein said means for temporarily fastening said vertical positioning straps one to the other is adjustably disposed along each said vertical positioning strap.

7. Apparatus as in claim 2 wherein said means for temporarily fastening said vertical positioning straps one to the other is manually operated.

8. Apparatus as in claim 1 wherein said means for removably attaching said vertical positioning straps to said spanning strap is adjustably received along said spanning strap.

9. Apparatus as in claim 1 wherein said means for removably attaching said vertical positioning straps to said spanning strap comprises a slideable loop formed by anchoring each said upper portion of said vertical positioning strap to itself to form a loop of such minimum circumference as to allow said spanning strap to slide therethrough.

10. Apparatus as in claim 1 further comprising:

a spanning strap having a left post placement area and a right post placement area;

a spanning strap having at least one post fixedly attached to said spanning strap;

at least one vertical positioning strap having at least one post aperture at said top portion;

and wherein said means for removably attaching said vertical positioning strap to said spanning strap comprises a post and post aperture.

11. Apparatus as in claim 10 wherein said means for temporarily fastening said vertical positioning straps one to the other is adjustably disposed along each said vertical positioning strap.

12. Apparatus as in claim 1 further comprising:

a spanning strap having a left post placement area and a right post placement area;

a spanning strap having at least two posts fixedly attached to at least one said post placement area of said spanning strap;

at least one vertical positioning strap having at least one post aperture at said top portion;

and wherein said means for removably attaching said vertical positioning straps to said spanning comprises at least two posts and one post aperture.

13. Apparatus as in claim 1 wherein said means for attaching said lower portions of said vertical positioning straps to a chair is lengthwise adjustable.

14. Apparatus as in claim 1 wherein said means for attaching said lower portions of said vertical positioning straps to a chair comprises a removable buckle adapted to receive said bottom end of said vertical positioning strap.

15. Apparatus as in claim 1 wherein said means for temporarily fastening said vertical positioning straps one to the other is removable.

16. Apparatus as in claim 1 wherein said means for temporarily fastening said vertical positioning straps one to the other is adjustably disposed along each said vertical positioning strap.

17. Apparatus as in claim 1 wherein said means for temporarily fastening said vertical positioning straps one to the other is manually operated.

* * * * *